United States Patent [19]

Tighe

[11] B 4,076,084

[45] Feb. 28, 1978

[54] ORIENTED DRILLING TOOL

[75] Inventor: Robert E. Tighe, Chicago, Ill.

[21] Appl. No.: 379,279

[22] Filed: Jul. 16, 1973

[73] Assignee: Amoco Production Company, Tulsa, Okla.

[44] Published under the second Trial Voluntary Protest Program on June 10, 1976 as document No. B 379,279.

[51] Int. Cl.[2] ..... E21B 7/06

[52] U.S. Cl. ..... 175/73; 175/61

[58] Field of Search ..... 175/61, 73, 76, 79, 175/81

[56] References Cited

U.S. PATENT DOCUMENTS

| | | | |
|---|---|---|---|
| 2,316,409 | 4/1943 | Downing | 175/73 |
| 2,891,769 | 6/1959 | Page et al. | 175/76 |
| 2,919,897 | 1/1960 | Sims | 175/76 |
| 3,352,370 | 11/1967 | Livingston | 175/73 |
| 3,572,450 | 3/1971 | Thompson | 175/76 |

*Primary Examiner*—David H. Brown

*Attorney, Agent, or Firm*—Paul F. Hawley

[57] ABSTRACT

This is a drilling tool which can be manipulated from the surface to one position to drill a directionally oriented hole or to a second position to drill a straight hole. A special tool is inserted in the drill string near the bit. It includes a hollow torque member, which is connected into the drill string. Surrounding the torque member are two eccentrically bored sleeves, one within the other. The two sleeves are rotatable with respect to each other and with respect to the torque member. When the cam sleeves are opposed, the torque member is aligned along the borehole axis. When the cam sleeves are oriented in the same direction, their eccentricity is added and the torque tube is thrown off center to cause the bit to drill in a prescribed direction. Means are provided so that the position of the sleeves can be changed from the surface. Manipulation is by mud circulation and pipe movement.

9 Claims, 15 Drawing Figures

20
53
6
4
16
2
51
3
7C
7A
16A
10
11
1
11'
22

2
2

52
39
15A
2
11
16
16A
54
3
53
2
15
51

15
11
40
16
16'
8A
8
10
15

1
11'

2
26
32
16A
L
6
17
54
40
8
7
38
18
3
3
39
40
24
10
11
1
5
5
28
11'
7
7
30
34
22

ORIENTED DRILLING TOOL

BACKGROUND OF THE INVENTION

1. Field of the Invention

This invention relates to directional drilling of boreholes in the earth. It relates especially to a downhole drilling tool whcih can be manipulated from the surface to drill either in a vertical or straight position, or in a directional drilling position.

2. Setting of the Invention

Oil and gas are produced from underground formations through wellbores drilled from the surface to the formation. Originally, it was desired to drill the well in as nearly a vertical direction as possible. However, in some cases, due to the particular geometry of the underground formation, it is nearly impossible to drill vertical wells. This is particularly true in steeply dipping formations in which the well keeps wanting to veer off to the updip side. Means is then required to cause the well to drill in the opposite direction. These tools which have been used for this purpose are ordinarily called directional drilling tools. Recently, it has become increasingly popular to drill wells in oriented directions. This is particularly true of offshore production. In those areas, a platform may be erected in water 100 to 200 feet or more deep and many wells drilled from a single platform. The wells will not be drilled in a vertical position, but will be drilled in a slanting or directional position in order to reach a particular subsurface location in the producing formation, which may be one or two miles in a lateral direction from the location of the platform.

Oriented directional drilling is generally at present accomplished by (1) a downhole motor to drive the bit, and a bent sub above the motor that permits orientation and causes the bit to drill in the oriented azimuth; (2) a downhole whipstock which cants the drill pipe in the oriented position; or (3) an arrangement of stabilizers on the lower drill string member which acts with the weight of the drill string members and applied drilling weight to cant the drill string toward either the high or low side of the hole. These methods require a special trip with the drill string to install the appropriate downhole equipment followed by one or more trips after directional drilling to return the bottom-hole drilling apparatus to that required for forward drilling of a full-size hole. Drilling progress may also be slowed during these operations because less than optimum drilling weight and rotary speed can be applied. The efficiency of the operation may be further affected by changes in the oriented direction during drilling due to the reaction between the rotating member and the wall of the hole.

As mentioned above, there are numerous directional drilling tools. The inventor knows of no drilling tool like the one he is claiming here. However, there are directional drilling tools which use the principle of eccentric sleeves. Typical of those are U.S. Pat. Nos. 2,712,434 and 2,173,309.

BRIEF DESCRIPTION OF THE INVENTION

This is a combination directional drilling and straight-hole drilling device which can be manipulated from one position to the other from the surface. It includes an inner cam sleeve rotatably mounted on a hollow torque member, e.g., a "limber" section of drill pipe. The bore of this sleeve is drilled off-center which in effect makes an eccentric inner cam sleeve. Rotatably mounted about the inner cam sleeve is an outer sleeve having longitudinal rib members on its outer surface. The rib members on one side of the tool are of a much greater radial dimension or thickness than those on the other. This, in effect, makes the outer sleeve an eccentric cam. The effective diameter of the outer surfaces is nearly full hole size. Means are provided to releasably connect the outer and inner sleeves together and further means are provided to connect the outer and inner sleeves both to each other and to the torque tube. These means are operable from the surface by rotation of the drill string and manipulation of the pressure of the drilling mud. When just the two sleeves are locked together, the eccentricity of the cams are additive, and the torque tube and drill string are thrown off center to permit directional drilling. The directional drilling force applied to the bit is the result of the applied drill collar weight above the tool acting through the off-center limber drilling member. When both sleeves are fixed to the torque tube, the sleeves or cams are opposed and the torque member is in the center of the borehole, and straight-hole drilling is then permitted.

BRIEF DESCRIPTION OF THE DRAWINGS

Various objectives and a better understanding can be had of the invention from the following description taken in conjunction with the drawings, in which.

DETAILED DESCRIPTION OF THE INVENTION

Figures 1, 2, 3, 4, 5, 6, 7:
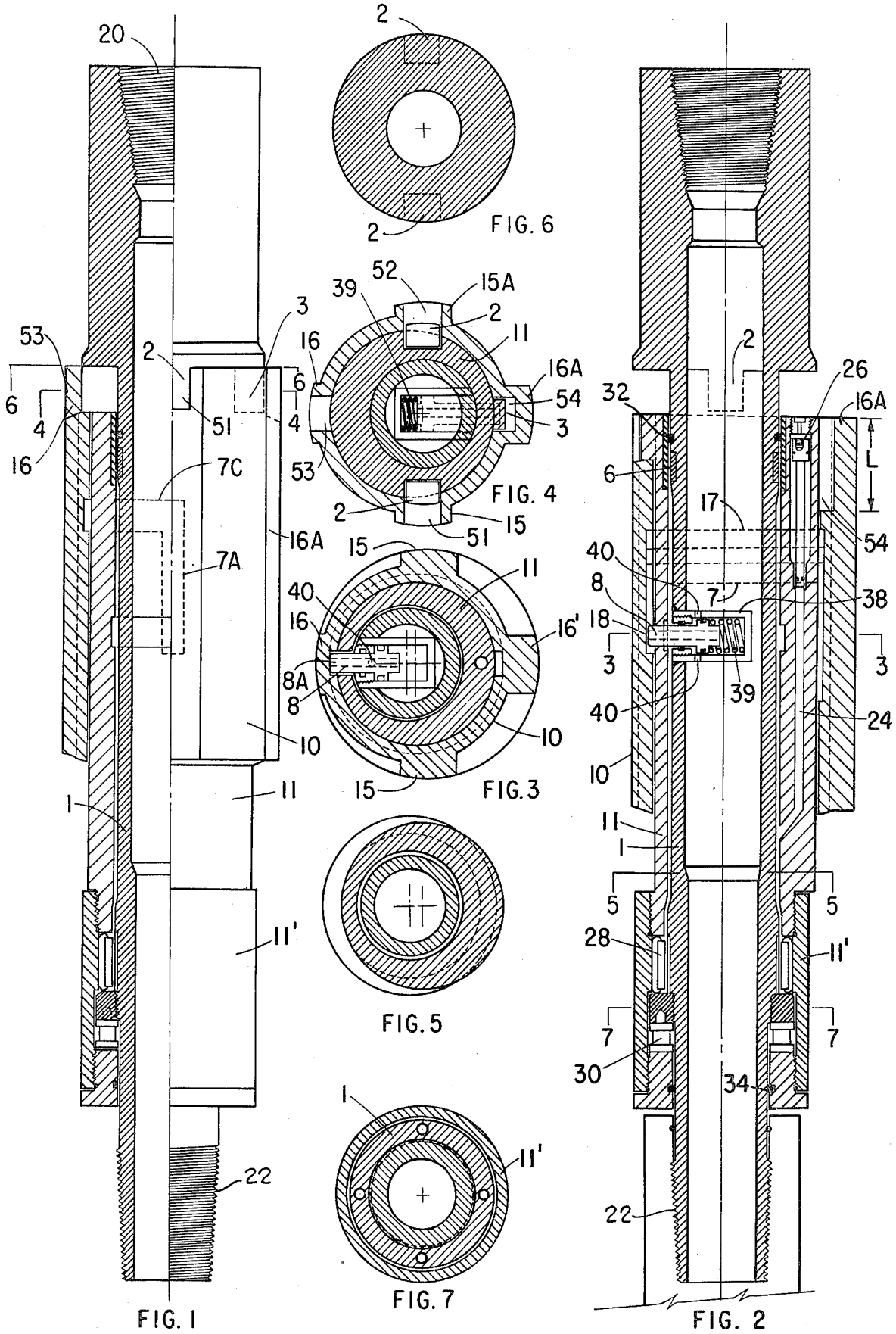
FIG. 1 is a view partially in section showing the tool when it is in its position for straight ahead drilling.
FIG. 2 is a full sectional view of the tool and is similar to the tool of FIG. 1, except in FIG. 2, the sleeves have been rotated so that the tool is in a directional drilling position.
FIG. 3 is a view taken along the line 3—3 of FIG. 2.
FIG. 4 is a view taken along the line 4—4 of FIG. 1.
FIG. 5 is a sectional view taken along the line 5—5 of FIG. 2.
FIG. 6 is a sectional view taken along the line 6—6 of FIG. 1.
FIG. 7 is a sectional view taken along the line 7—7 of FIG. 2, and FIGS. 8, 9, 10, 11, 12 and 13 are schematic views of key components of the apparatus shown in detail in FIGS. 1 and 2 in their various positions as the tool is changed from either its straight-hole or directional drilling position to the other. These figures are useful in explaining the operation of the device of FIGS. 1 through 7.

Attention is first directed to FIGS. 1 and 2 and their accompanying sectional views 3 through 7. Shown thereon, is an inner torque tube or torque member 1, which in effect is a hollow member having female threads 20 at the top and male threads 22 at the bottom for connection into a drill string just above the bit. An inner cam sleeve 11 is rotatably mounted about torque member 1. Inner cam sleeve 11 can rotate about torque member 1 but is held in a longitudinal fixed position therewith. Inner cam sleeve 11 is provided with a lower extension 11'. Between extension 11' and torque member 1, there is provided a radial bearing 28 and a thrust bearing 30. An upper radial bearing 6 is provided between the upper end of cam sleeve 11 and torque member 1. Proper seals 32 and 34 are provided at the upper and lower end, respectively, of inner cam 11 between it and torque member 1. As can be seen especially clear in FIGS. 3 and 4, the bore through inner cam 11 is off center, thus forming in effect a cam. Inner cam sleeve 11 has a lubricating channel 24 with closure means 26 at the top thereof. Sleeve 11 is provided with a lug 3 at its upper end. The purpose of this lug 3 is to engage a slot in outer cam member 10 when the two are in the proper position, as will be explained. Outer cam 10 surrounds inner cam sleeve 11 and is slideable longitudinally therewith.

As can be seen clearly in FIG. 4, outer cam sleeve 10 is provided with 4 equally spaced ribs 15, 15A, 16 and 16A. Ribs 15 and 15A are approximately the same radial dimension. However, rib 16A has a much greater radial dimension or thickness than does rib 16. This is what gives the outer member 10 its cam shape. Each of these ribs 15, 15A, 16 and 16A are provided with slots 51, 52, 53, and 54, respectively. The axial or longitudinal dimension of the slot 53 in rib 16 is essentially the same as that of the lug 3 of inner cam 11. The longitudinal or axial dimension "L" of slot 54 is equal to about the sum of the longitudinal dimensions of lug 2 of member 1 and lug 3 of inner cam 11. As can be seen in FIGS. 6 and 4, inner member 1 has two oppositely faced downwardly facing lugs 2 which are arranged to mate with the slots 51 and 52 in the ribs 15 and 15A of outer cam 10. One might desire to use more than two lugs 2 with associated slots. Three lugs 2, for example, could be easily designed to give the lugs comparable metal thickness as the drill pipe area to make it strong in withstanding torque.

A piston 8 is mounted in cylinder 38 within inner torque member 1. Piston 8 is biased by a spring to an outer position. Piston 8 has axial passage 8A so that pressure in cylinder 38 occupied by the spring is at essentially the same pressure as the pressure of the drilling fluid in the annulus outside the tool. The application of fluid pressure in the drill string, when drilling mud pumps are started, acts through port 40 in the wall of cylinder 38 to drive piston 8 inwardly thus compressing the spring. The strength of spring 39 and areas of piston 8 in fluid communication with high internal pressure and lower external pressure are designed and sized to permit this function. When the mud pumps are stopped, the piston 8 is extended. Piston 8 is longitudinally aligned with a hole 18 in inner cam sleeve 11.

Outer cam sleeve 10 is provided with two sets of grooves in the inner wall thereof. Each groove extends slightly over 180°, so that the ends thereof overlap by the distance of the dimension of the diameter of piston 8. One groove 17 is merely a circumferential groove of a sufficient size to receive the end of piston 8.

Internal groove 7 of outer cam 10 is located below groove 17 and is composed of horizontal segment 7C and two downwardly extending vertical legs 7A and 7B at the end thereof. These are shown more clearly in FIGS. 8, 9 and 10. The longitudinal distance from slot section 7C to the top of outer cam sleeve 10 is slightly less than the distance from hole 18 in inner cam sleeve 11 to the lower side of lug 3. Vertical leg 7B extends down along rib 16A such that the distance from the bottom of groove 7B to the bottom of the slot 53 at the top of rib 16 is equal to or greater than the longitudinal distance from hole 42 in inner cam sleeve 11 to the bottom of lug 3. Vertical groove segment 7A is longer than segment 7B by a distance approximately equal to the longitudinal dimension of lug 3.

Member 1 of the tool is connected to "limber drill string members" 80 and 82 on opposite ends of the tool. The limber drill string members are tubular members and are used to transmit the applied drilling weight and high pressure drilling fluid to the bit. The diameter of the limber members is sufficiently smaller than hole diameter to permit the off-center deflection built into the tool, and of appropriate cross sectional area so as to safely bear the axial and bending forces imposed. The limber members might be, but not limited to, regular size drill pipe or small diameter drill collars. The length of the limber members on either side of the tool is related to the cross sectional area of the members as it pertains to stiffness and the stability of the members in preventing second order buckling under specific load and hole conditions. A sometimes appropriate, but not limiting, length for drill pipe size members 80 and 82 is 10 to 20 feet.

Although not specifically shown in the device described herein and in the drawings, a non-magnetic drill collar with orienting directional survey landing equipment is provided. Such drill collar will not be described here inasmuch as its construction and operations are well known.

The various structural members and their relationship to each other have been described above. Attention will now be directed to FIGS. 8 through 13 for an explanation of how these various members cooperate with each other when they are manipulated from a first position to cause the bit to drill straight ahead to a second position so that the bit drills from an offset position and further manipulation to return the apparatus to the first position so that the bit drills in a straight ahead position.

Figure 8:
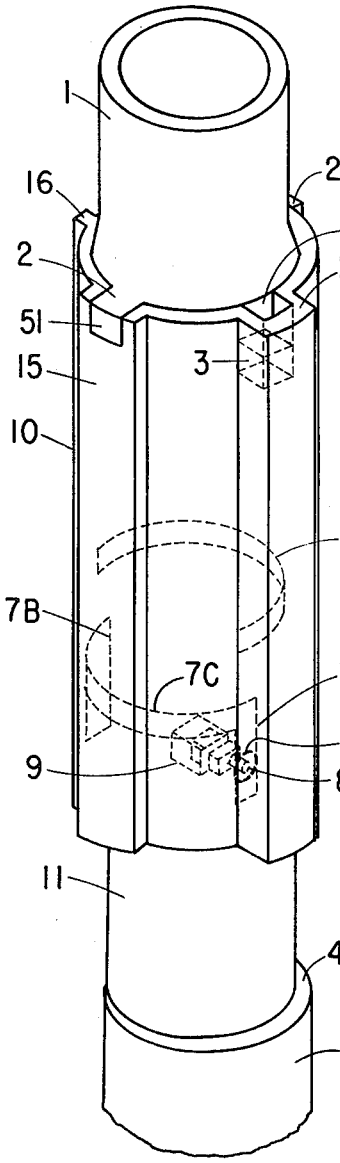
Figure 9:
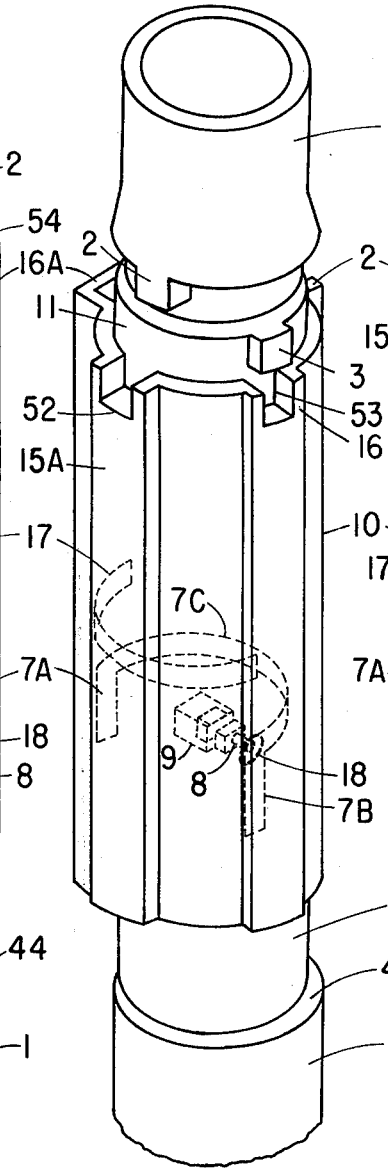

When it is desired to run the tool into the wellbore from the surface, the tool is in its centered position as shown in FIG. 8. There, inner cam sleeve 11 is locked against rotation to outer cam sleeve 10 by lug 3 being positioned in the upper slot 54 in the upper end of rib 16A. Outer cam sleeve 10 is secured against rotation to torque member 1 by having lug 2 of torque member 1 set in the slots 51 and 52 in the upper end of ribs 15 and 15A. During this time, the drill pipe is not pressured and the piston 8 is extended through the opening 18 in the inner cam sleeve 11 into the guide slot 7A of the outer cam sleeve 10. During downward movement of the drill string, wall friction develops with the outer cam sleeve 10 and the cam tends to slide upwardly or be forced upwardly so that the torque lugs 2 stay engaged in the slots 51 cut in the upper edge of rib 15. Drilling mud circulation or drilling may be commenced at any desired spot during the trip. During mud circulation, internal drill string pressure forces the piston 8 to retract into the piston chamber but the orientation of outer sleeve 10 and the inner cam 11 is retained because of the engagement of the lugs 2 and 3 as described above. The friction of the ribs of the outer case of the wall of the wellbore prevents the outer case or sleeve 10 from sliding downward with respect to lugs 2 and 3. So long as the cam sleeve 10 is prevented from sliding down, the lugs 2 and 3 stay engaged. Force of downward movement of the drill string is transmitted through lugs 2 and 3 to cam sleeve 10 to cause the sleeve to slide downward in the borehole. Return mud flow is allowed by the area between the ribs of outer cam 10.

Figure 10:
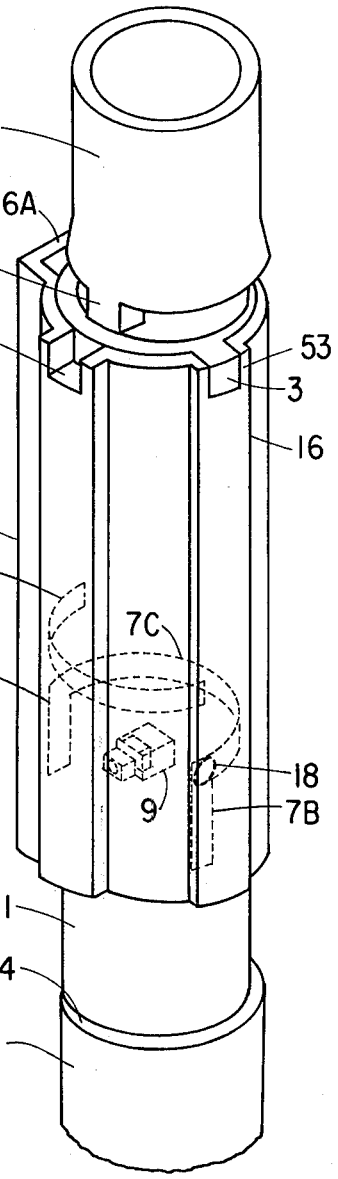

I shall now discuss the steps necessary when I change the tool from its straight-hole drilling to its directional drilling position. Circulation is first stopped. Piston 8 is then extended through hole 18 of inner cam sleeve 11 into groove 7A of outer cam sleeve 10. Note that piston 8, hole 18, and groove 7A are aligned when lug 3 is in slot 54 of rib 16A. A directional survey is run to determine tool orientation. A suitable procedure is well known and is commercially available. With the lugs 2 still engaged in the slots 51 and 52 of ribs 15 and 15A, the tool is rotated to the desired orientation. Next, still with no internal pipe pressure (except the hydrostatic head), the drill string is picked up about a foot, which causes the outer cam sleeve 10 to move downwardly (relatively) on the inner cam sleeve 11 due to wall friction. This action disengages lugs 2 and 3 and the piston 8 is extended into the guide grooves 7C of outer cam sleeve 10. The drill string is then rotated one-half turn (180°). This is to a position illustrated in FIG. 9, which shows the drill pipe (torque member 1) rotated 180° with respect to outer cam sleeve 10. The views of FIGS. 9, 10, 12 and 13 are rotated 180° from the view of FIG. 8 for convenience of illustration. The piston 8 stops relative rotation between torque member 1 and inner cam sleeve 11 and the outer cam sleeve 10 as piston 8 reaches the end of the horizontal part 7C of the guide groove. The drill string is then lowered and the outer casing remains stationary due to wall friction so that lug 3 of the inner cam sleeve 11 slips into slot 53 of rib 16. This stops further independent travel between the outer cam sleeve 10 and inner cam sleeve 11. The drill pipe is now eccentric with respect to the axis of the hole, and the axis of the drill pipe is canted in the desired direction of drilling. The relative position of the cams is shown in FIG. 10. Mud circulation is next resumed. The resulting internal pressure retracts piston 8 so that the torque member 1 rotates free of engagement with the inner cam sleeve 11 or outer cam sleeve 10. Friction contact between the inner cam sleeve 10 and the torque member is minimized through the action of lubricated radial bearings and thrust roller bearings.

During directional drilling, sufficient drilling weight is maintained to provide a positive bending moment on the bent member drill string in the oriented drilling direction. Azimuth orientation of the stabilizer is maintained by wall contact forces developed by pipe bending stress and supplemented by hole inclination angle. Optimum drilling weight and rotary speed may be used during all drilling operations with the eccentric stabilizer of this invention.

Figure 13:
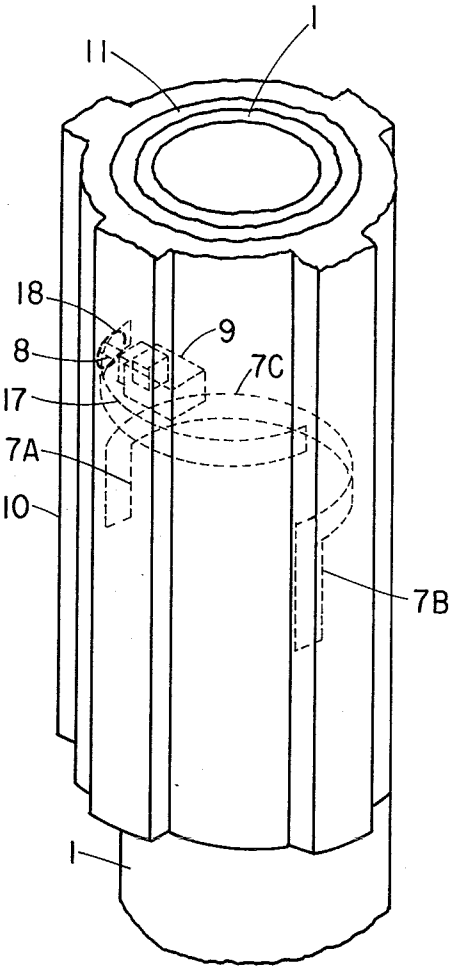
Figure 12:
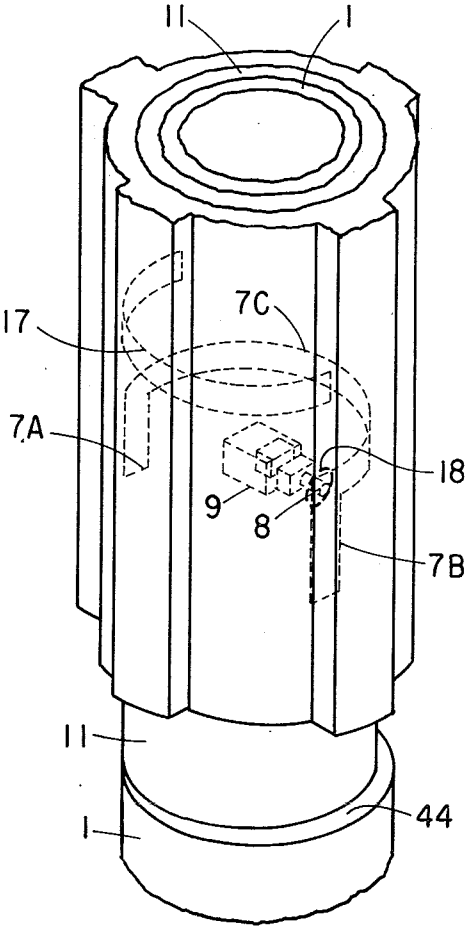
Figure 11:
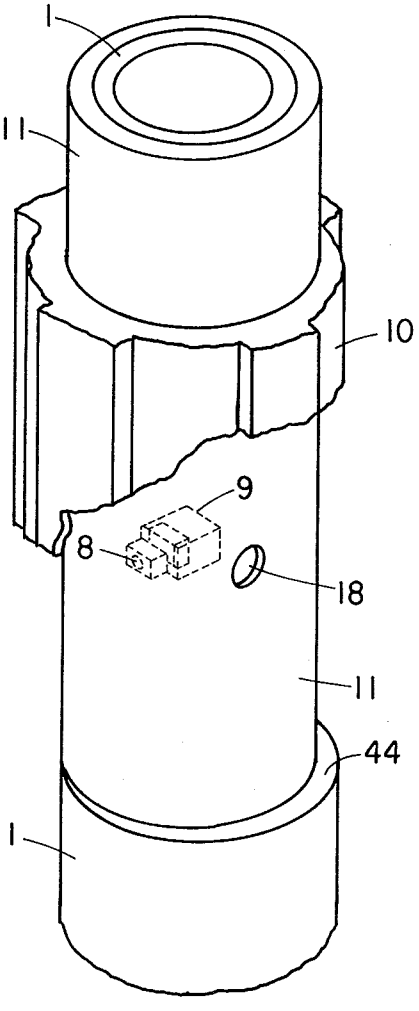
Figure 14:
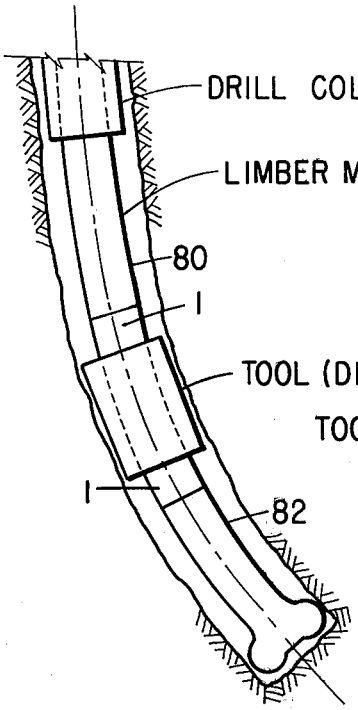
FIG. 14 is a downhole view of a typical application of the apparatus for off-center or directional drilling.
Figure 15:
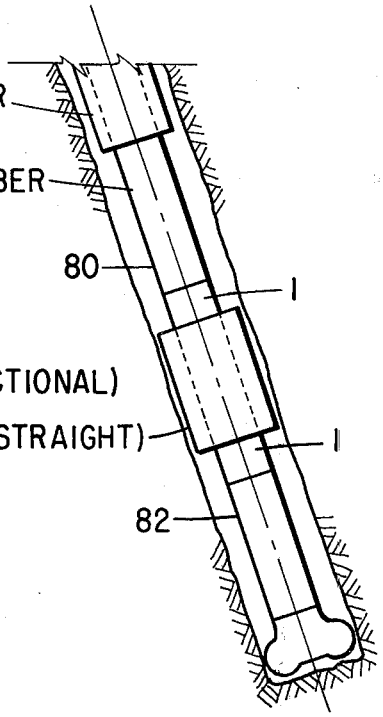
FIG. 15 is a downhole view of a typical application of the apparatus of my invention for straight-hole drilling.

Attention will now be directed toward the manipulation of the device so that I can again put it in a position where it drills "straight ahead", i.e., in a centralized position. The eccentric stabilizer can be manipulated downhole to become centralized again for continued forward drilling. What I do now is take the device from the position in FIG. 10 and show how it is manipulated to return to the position of FIG. 8. I first slow down rotation of the drill string. I rotate not over one turn. This position can be determined when there is a large increase in torque which indicates that piston 8 has entered hole 18 of inner cam sleeve 11. The tool is now in the position shown in FIG. 12. What I wish to do is end up with piston 8 in slot 7A, without turning the drill string to the left. I next turn on the pumps and lift up the drill string to move piston 8 from the level of slot 7 to the level of slot 17. In building the tool, I located groove 17 so that when outer cam sleeve 10 is resting on shoulder 44 of torque member 1, piston 8 is on the same level as internal groove 17. I now turn off the pumps and piston 8 moves into groove 17. I next rotate the drill pipe one-half turn to the right to where piston 8 is in groove 17 above groove 7A, as shown in FIG. 13. I next turn on the pump which retracts piston 8. Then I sit down on the drill pipe. The drill string is lowered and friction prevents outer cam sleeve 10 from being lowered. Then, lugs 2 engage the slots 51 and 52 of ribs 15 and 15A of outer cam sleeve 10 and lug 3 of inner sleeve cam 11 engages slot 54 of outer cam sleeve 10. The tool has now been returned to its straight-hole position, as shown in FIG. 10.

Some of the important features of the directional tool described in this invention follow.

The tool provides a positive shift in the drill string axis at the tool to effect an off-center position with respect to the hole axis. The shift for a 7⅞ hole size is calculated to be about ¾. This is based on the design of the bores of inner cam sleeve 11 and outer cam sleeve 10 being off center by about ⅜. The tool may be shifted to the eccentric or stabilized position without "pulling" the drill string. In the eccentric position, the inner torque member 1 is unlocked from the cam sleeves 10 and 11 and is free to rotate on lubricated bearings. Radial bearing loads are limited to the side forces on the tool and thrust bearing loads are limited to those resulting from hole drag on the tool.

Drilling mud system hydraulics should not be appreciably altered by the tool during drilling operations.

In the center position, the tool is locked together with no relative movement between the components. This eliminates wear and maximizes tool life.

While the above description of the invention has been given in detail, it is possible to produce modifications therefrom without departing from the spirit or scope of the invention.

What I claim is:

1. An apparatus to be used in a borehole drilled by a drill bit at the lower end of a drill string, which comprises:

a. a hollow torque tube, b. an inner cam sleeve having a cam-shaped cross section and rotatably mounted on the torque tube, c. an outer cam sleeve having a cam-shaped cross section and rotatably mounted about said inner cam sleeve, d. remotely actuatable means to releasably secure said outer cam sleeve to said inner cam sleeve, e. remotely actuatable means to releasably secure said outer cam sleeve to said hollow torque tube.

2. An apparatus as defined in claim 1 including means to releasably secure said inner cam sleeve directly to said hollow torque tube which includes a hole in said inner cam sleeve and a retractable piston carried by said hollow torque tube to extend into said hole when there is no pressure in excess of hydrostatic pressure in the interior of said hollow torque tube and to retract when pressure is applied to the interior of said hollow torque tube.

3. An apparatus as defined in claim 1 including:
an upper flexible drill string member connected between the upper end of said torque tube and the drill string,
a lower flexible drill string member connected between the lower end of said torque tube and said bit.

4. An apparatus for use in a wellbore drilled by a bit suspended at the lower end of the drill string, which comprises:
a. a hollow torque tube insertable into the lower end of said drill string above said bit,
b. an inner eccentrically bored sleeve rotatably mounted about said torque tube, said inner eccentrically bored sleeve having a thick section on one side, which has a radial thickness $t_1$ which is much thicker than a thin section having a radial thickness $t_2$ on the opposite side of said sleeve,
c. an outer cam sleeve rotatably mounted about said inner eccentrically bored sleeve and movable longitudinally therewith between an upper position and a lower position, said outer cam sleeve having a plurality of ribs on the external surface thereof, one rib having a radial thickness $t_3$ which is much greater than the radial thickness $t_4$ of a diametrically opposite rib, $t_1 - t_2$ being essentially the same as $t_3 - t_4$, said outer cam sleeve having an upper and a lower position relative to said inner eccentrically bored sleeve,
d. anchor means to releasably secure said inner eccentrically bored sleeve to said hollow torque tube to prevent rotation,
e. means to prevent rotational movement between said outer cam sleeve and said torque tube when said outer cam sleeve is in its upper position but only when its thick rib is opposite the thick portion of said inner eccentrically bored sleeve,
f. means to prevent rotation between said outer cam sleeve and said inner eccentrically bored sleeve when said outer cam sleeve is in its upper position.

5. An apparatus as defined in claim 4 in which said anchor means includes:
a hole in said inner eccentrically bored sleeve,
an enclosed cylinder in said torque tube radially positioned therein at the same level as said hole,
a retractable piston mounted in said cylinder, said piston having a stem which when extended extends through the end of said cylinder and through said hole and when retracted has no part in said hole,
a spring in said cylinder urging said piston radially outwardly,
a hole in said cylinder on the side of said piston opposite said spring,
first sealing means between said piston and said cylinder,
second sealing means between said stem and the end of said cylinder through which it passes,
a longitudinal passage through said piston and stem.

6. An apparatus for use in drilling a borehole which comprises:
a. a hollow cylindrical torque tube,
b. a first eccentrical cylindrical sleeve having a bore slightly larger than the outside diameter of said torque tube, said first eccentrical cylindrical sleeve rotatably mounted about said torque tube,
c. a second eccentrical sleeve having a bore slightly larger than the outside of said first eccentrical cylindrical sleeve and rotatably mounted thereon,
d. means to secure said torque tube, said first eccentrical cylindrical sleeve and said second eccentrical sleeve in a non-rotatable relationship with the eccentricity of said first sleeve and said second sleeve opposed so that the axis of said second sleeve coincides with the axis of said torque tube,
e. means to secure said first and second sleeves in a non-rotatable relationship with said first sleeve in a rotatable relationship with the eccentricity of said first and second sleeve adding so that the axis of said second sleeve is displaced from the axis of said torque tube.

7. An apparatus for use in a wellbore drilled by a bit suspended at the lower end of the drill string, which comprises:
a. a hollow torque tube insertable into the lower end of said drill string above said bit,
b. an inner eccentrically bored sleeve rotatably mounted about said torque tube, said inner eccentrically bored sleeve having a thick section on one side, which has a radial thickness $t_1$ which is much thicker than a thin section having a radial thickness $t_2$ on the opposite side of said sleeve,
c. an outer cam sleeve rotatably mounted about said inner eccentrically bored sleeve and movable longitudinally therewith between an upper position and a lower position, said outer cam sleeve having four equally spaced ribs on the external surface thereof, one rib having a radial thickness $t_3$ which is much greater than the radial thickness $t_4$ of a diametrically opposite rib, $t_1 - t_2$ being essentially the same as $t_3 - t_4$, said outer cam sleeve having an upper and a lower position relative to said inner eccentrically bored sleeve,
d. an outwardly projecting lug on the upper end of said inner eccentrically bored sleeve,
e. at least a pair of lugs on said hollow torque tube positionable 90° from said lug on said inner eccentrically bored sleeve at a level just above said lug,
f. a slot in the upper end of each of said ribs on said outer cam sleeve, the side slots on the ribs 90° from the thick rib being of a size to receive the lugs on said torque tube and the slots in said thick rib and its opposite rib being of a size to receive the lug on said inner eccentrically bored sleeve, the slot in said thick rib having a longitudinal length of approximately the sum of the longitudinal dimensions of said lug on said inner eccentrically bored sleeve and a lug on said torque tube,
g. a hole in said inner eccentrically bored sleeve,
h. a cylinder supported by said torque tube and longitudinally aligned with said hole,
i. a retractable piston mounted in said cylinder, said piston having a stem which when extended extends through the end of said cylinder and through said hole and when retracted has no part in said hole,
j. a lower circumferential groove in the inner wall of said outer cam sleeve extending circumferentially from said thick rib to said thin rib, when said outer cam sleeve is in an intermediate position between its upper and lower position said slot is on the same level with said hole in said inner eccentrically bored sleeve, a long and a short vertical groove intersecting the ends of said lower circumferential groove and extending toward the bit end of said tool, the bottom of said long vertical groove which is adjacent said thick rib being at the same level as said hole when said outer cam sleeve is in its upper position, the side slots engage the lugs on the torque tube, said short vertical interior groove intersecting said lower groove and aligned with the thin rib, the lower end of said short vertical groove being at the same level as the hole in said inner eccentrically bored sleeve and said slot on said thin rib receives the lug from said inner cam sleeve, k. an upper interior circumferential groove on the interior wall of said outer cam sleeve spaced above said first interior groove and extending from said short vertical groove to said long vertical slot in the opposite 180° circumferentially from that of said lower circumferential groove, when said outer cam sleeve is in its lower position said upper circumferential groove is at same level as said hole in said inner eccentrically bored sleeve.

8. An apparatus as defined in claim 6 including, a hole in said cylinder on the side of said piston opposite said spring, first sealing means between said piston and said cylinder, second sealing means between said stem and the end of said cylinder through which it passes, a longitudinal passage through said piston and stem.

9. An apparatus to be used in a borehole drilled by a drill bit at the lower end of a drill string, which comprises:

a. a hollow torque tube, b. an inner cam sleeve rotatably mounted on the torque tube, c. an outer cam sleeve rotatably mounted about said inner cam sleeve, d. means to releasably secure said outer cam sleeve to said inner cam sleeve, e. means to releasably secure said outer cam sleeve to said hollow torque tube, f. an upper flexible drill string member connected between the upper end of said torque tube and the drill string, g. a lower flexible drill string member connected between the lower end of said torque tube and said bit.

* * * * *